US009546645B2

(12) United States Patent
Allidieres

(10) Patent No.: US 9,546,645 B2
(45) Date of Patent: Jan. 17, 2017

(54) DEVICE AND METHOD FOR PUMPING A CRYOGENIC FLUID

(75) Inventor: Laurent Allidieres, Saint Martin D'Uriage (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 1033 days.

(21) Appl. No.: 12/993,009

(22) PCT Filed: May 7, 2009

(86) PCT No.: PCT/FR2009/050844

§ 371 (c)(1),
(2), (4) Date: Nov. 16, 2010

(87) PCT Pub. No.: WO2009/150337

PCT Pub. Date: Dec. 17, 2009

(65) Prior Publication Data

US 2011/0070103 A1 Mar. 24, 2011

(30) Foreign Application Priority Data

May 16, 2008 (FR) ..... 08 53168

(51) Int. Cl.
*F04B 49/06* (2006.01)
*F04B 15/08* (2006.01)
*F04B 23/02* (2006.01)

(52) U.S. Cl.
CPC ..... *F04B 15/08* (2013.01); *F04B 23/02* (2013.01); *F04B 2205/01* (2013.01)

(58) Field of Classification Search
CPC ..... F17C 5/007; F17C 5/04; F17C 5/02; F17C 7/02; F17C 2227/0107; F17C 2227/0192; F17C 2227/0135; F17C 2227/0306; F17C 2227/03; F17C 2227/0302; F04B 15/08
(Continued)

(56) References Cited

U.S. PATENT DOCUMENTS 5,243,821 A * 9/1993 Schuck ..... F17C 7/04 417/53
5,360,139 A * 11/1994 Goode ..... F17C 5/007 141/18
(Continued)

FOREIGN PATENT DOCUMENTS

DE 102006019993 12/2007
FR 2439881 5/1980
(Continued)

OTHER PUBLICATIONS

WO 2007036651 A1 Translation.*
International Search Report for PCT/FR2009/050844, mailed Dec. 18, 2009.

*Primary Examiner* — Frantz Jules
*Assistant Examiner* — Brian King
(74) *Attorney, Agent, or Firm* — Christopher J. Cronin

(57) ABSTRACT

The invention relates to a device for pumping a cryogenic fluid, consisting of a tank for storing a cryogenic fluid containing cryogenic liquid, a cryogenic pump having an inlet pressure loss, and a suction line connecting the tank to the pump, said pumping device including a system for controlling the pressure in the tank for selectively maintaining said pressure at least equal to the saturation pressure of the stored cryogenic fluid plus the inlet pressure loss of the cryogenic pump and optionally plus the value of the pressure losses owing to the pipes forming the suction line connecting the tank to the pump. The invention is characterized in that the pressure-control system includes a duct connecting a high-pressure outlet of the pump to the tank for selectively
(Continued)

returning the pumped cold fluid to the tank, said duct including an expansion valve for returning cold gas to the tank.

19 Claims, 2 Drawing Sheets

(58) Field of Classification Search
USPC ..... 62/48.1, 50.6, 50.1, 45.1, 50.2
See application file for complete search history.

(56) References Cited

U.S. PATENT DOCUMENTS

| | | | | |
|---|---|---|---|---|
| 5,467,603 | A * | 11/1995 | Lehman et al. | 62/50.2 |
| 6,564,579 | B1 * | 5/2003 | McCartney | F17C 9/02 62/50.2 |
| 7,647,774 | B2 * | 1/2010 | Shirk et al. | 60/651 |
| 2003/0213246 | A1 * | 11/2003 | Coll | F01K 17/02 60/653 |
| 2004/0112066 | A1 * | 6/2004 | Leitch et al. | 62/48.1 |
| 2006/0053806 | A1 * | 3/2006 | Tassel | 62/48.1 |
| 2007/0068176 | A1 * | 3/2007 | Pozivil | F17C 3/025 62/45.1 |

FOREIGN PATENT DOCUMENTS

| | | | | |
|---|---|---|---|---|
| FR | 2506400 | | 11/1982 | |
| WO | WO 02 064395 | | 8/2002 | |
| WO | WO 2005 085637 | | 9/2005 | |
| WO | WO2005085637 | * | 9/2005 | F04B 15/08 |
| WO | WO 2005085637 | A1 * | 9/2005 | |
| WO | WO 2007036651 | A1 * | 4/2007 | F17C 5/007 |

* cited by examiner

DEVICE AND METHOD FOR PUMPING A CRYOGENIC FLUID

CROSS-REFERENCE TO RELATED APPLICATIONS

This application is a §371 of International PCT Application PCT/FR2009/050844, filed May 7, 2009, which claims §119(a) foreign priority to French application 0853168, filed May 16, 2008.

BACKGROUND

Field of the Invention

The present invention relates to a device and to a method for pumping a cryogenic fluid.

The invention relates more particularly to a device for pumping a cryogenic fluid, comprising a storage tank for storing a cryogenic fluid containing cryogenic liquid, a cryogenic pump having an inlet head loss (NPSH), and a suction line connecting the tank to the pump.

The invention finds a particularly advantageous application in the field of the pumping of low-density cryogenic fluids containing gases such as hydrogen or helium, and isotopes thereof.

Related Art

Compressing liquid hydrogen makes it possible to reduce the compression costs by comparison with compressing gaseous hydrogen given that it is easier to compress a volume of incompressible liquid than a volume of gas.

Generating this high pressure is extremely expensive in terms of compression energy. In addition, the evaporative losses of liquid hydrogen in a pump may also be high if the pump is not used optimally. Reducing the losses (both friction losses and gas losses) is therefore a key issue in optimizing the costs of obtaining high-pressure hydrogen.

One of the problems with cryogenic pumps in general and with liquid hydrogen pumps in particular is that the fluid that is to be pumped is very low density (70 g/l at 1 bar). It is therefore difficult if not impossible to provide the pump with the suction pressure it requires simply by physically installing the source tank on the pumping installation with a head of pressure (hydrostatic head). The problem is that the suction pressure has to take account of the pump inlet head loss (NPSH=Net Positive Suction Head, that is to say the difference in pressure between the saturation pressure of the gas that is to be pumped and the fluid suction pressure needed for the pump to operate in a pure liquid phase without cavitation).

For example, a liquid hydrogen (LH2) pump at 700 bar has a head loss (NPSH) of around 250 mbar, which corresponds to a 35 m head of liquid hydrogen. It is impossible to run the pump with a source tank installed on the pump with a pressure head of 35 m (and even if this were industrially possible, the head losses in the lines would counterbalance the fact that the tank had been installed with such a pressure head). One solution is therefore to "supercool" the liquid and to suck up this liquid in its supercooled state. Supercooling involves increasing the pressure of a fluid to saturation or reducing its temperature, at constant pressure, without waiting for a new liquid-vapor equilibrium to become established.

Pressurized hydrogen, however, is even less dense than hydrogen at atmospheric pressure. For example, the density of saturated hydrogen at 1 bar absolute is 70 g/l whereas it is 56 g/l at 7 bar absolute. Given that liquid hydrogen pumps are positive-displacing systems, it is therefore beneficial to suck up the hydrogen when it is as dense as possible, and therefore when it is saturated at the lowest possible pressure (as cold as possible), the purpose of this being to optimize the quantities pumped.

The invention described hereinbelow notably makes it possible to use a liquid hydrogen pumping plant continuously from a hydrogen source in liquid/gas equilibrium at a low pressure (of between 1 and 12 bar) and to optimize the operation of such a plant by allowing the pump to operate continuously while at the same time maximizing the density of the pumped hydrogen, and therefore maximizing the pumped output.

In existing solutions, the tank is pressurized using thermosiphon (a heater that establishes atmospheric pressure) or directly using high-pressure hydrogen from cylinders at ambient temperature.

During the running of these known systems, the hydrogen at ambient temperature injected into the roof of the tank gradually heats up the liquid, reducing the available level of supercooling.

This then increases the rated pressure of the tank, with the effect of reducing the pumping time available before the tank reaches its maximum operating pressure.

Document WO2005/085637A1, in the name of the applicant company, notably describes a pumping system comprising pressure control means capable of keeping the pressure in the suction line of the pump at most equal to the saturation pressure of the cryogenic fluid increased by the inlet head loss of the cryogenic pump.

It is one object of the present invention to alleviate all or some of the abovementioned disadvantages of the prior art.

SUMMARY OF THE INVENTION

To this end, there is disclosed a device for pumping a cryogenic fluid, comprising a storage tank for storing a cryogenic fluid containing cryogenic liquid, a cryogenic pump having an inlet head loss (NPSH), a suction line connecting the tank to the pump, the pumping device comprising a system for controlling the pressure in the tank in order selectively to keep the pressure in the tank at least equal to the saturation pressure of the cryogenic fluid stored increased by the inlet head loss (NPSH) of the cryogenic pump and possibly also increased by the value of the head loss due to the pipework of the suction line connecting the tank to the pump. The pressure control system comprises at least one out of: a pipe connecting a high-pressure outlet of the pump to the tank in order to selectively reinject pumped cold fluid into the tank, a pipe connecting a high-pressure gas source to the tank via a cooling member that cools the gas, so as to selectively inject cooled gas into the tank.

Moreover, some embodiments of the invention may comprise one or more of the following features:

- the pressure control system comprises a pipe connecting a high-pressure outlet of the pump to the tank in order to reinject pumped fluid into the tank while the pump is operating, and a pipe connecting a high-pressure gas source to the tank via a cooling member, so as to inject cooled gas into the tank notably when the pump is inactive.
- the pipe connecting a high-pressure outlet of the pump to the tank comprises an expansion valve for reinjecting cold gas into the tank,
- the cooling member situated in the pipe connecting the high-pressure gas source to the tank comprises a heat exchanger able selectively to place the gas from the high-pressure gas source in a heat-exchange relationship with the cryogenic fluid pumped from the tank, the heat exchanger comprises a cold energy accumulator so as, through thermal inertia, to maintain a cooling power between two uses of the pump.

the high-pressure source is connected to a high-pressure outlet of the pump via at least one out of: a valve, an expansion valve, a heater so as to allow said source to be selectively filled with fluid from the tank.

the device comprises a discharge line for discharging the gas generated by the operation of the pump, said gas discharge line connecting a gas outlet of the pump to the tank or to a separate degassing storage facility, the cold energy accumulator comprises at least one out of: a mass of aluminum, a mass of glycol water, of copper or of lead-based alloy, the cold energy accumulator of the heat exchanger has a specific heat capacity (density×heat capacity at constant pressure) of between 1400 and 4000 $kJ \cdot m^{-3} \cdot K^{-1}$ and a thermal conductivity of between 30 and 400 W/m–K, the pressure control system comprises a pressure sensor and a temperature sensor for the cryogenic fluid in the tank and/or in the suction line, these being connected to a control and computation logic to supply the measured signals so as to command the injection of fluid into the tank from the pump (3) (via the pipe 9) and/or from the high-pressure gas source (16) (via the pipe 10, 9), the device comprises a gas supply line with one end that can be connected to a user and one end connected to a high-pressure outlet of the pump via at least one heater and one expansion valve, the pressure control system comprises at least one command and computation unit capable of computing, from the temperature measured by said temperature sensor, a minimum value of the pressure measured by said pressure sensor equal to the saturation pressure of the liquid at said temperature increased by the inlet head loss (NPSH) of the pump and by any head losses in the pipework of the suction line, the tank is filled with cryogenic fluid saturated with its vapor, the cryogenic fluid preferably being a low-density fluid such as hydrogen or helium, the gas for the high-pressure gas source comes from the tank.

The invention also relates to a method for pumping a cryogenic fluid from a cryogenic fluid tank containing cryogenic liquid, the fluid being pumped via a suction line comprising a cryogenic pump having an inlet head loss (NPSH), the method comprising a step of controlling the pressure in the tank in order selectively to keep the pressure in the tank and/or in the suction line at least equal to the saturation pressure of the cryogenic fluid increased by the inlet head loss (NPSH) of the cryogenic pump and possibly also increased by the value of the head loss due to the pipework in the suction line connecting the tank to the pump.

According to one advantageous specific feature, the method is characterized in that the step of controlling the pressure in the tank involves introducing so-called cold gas into the tank at a temperature lower than the ambient temperature outside the tank, and preferably of between 40° K and 100° K and at a pressure of between 1 and 12 bar.

Moreover, some embodiments of the invention may comprise one or more of the following features:

the cold gas introduced into the tank to control the pressure in the tank is supplied by at least one out of: a pipe connecting a high-pressure outlet of the pump to the tank, a pipe connecting a high-pressure gas source to the tank via a cooling member that cools the gas, the cold gas introduced into the tank is supplied selectively by a pipe connecting a high-pressure outlet of the pump to the tank when the pump is operating and by a pipe connecting a high-pressure gas source to the tank via a gas cooling member when the pump is shut down, the cold gas supplied by the pipe connecting a high-pressure outlet of the pump to the tank is obtained by expanding the fluid from the high-pressure outlet of the pump, and in that the member that cools the gas from the high-pressure gas source uses the cold energy of the fluid pumped from the tank.

The invention may relate also to any alternative device or method comprising any combination of the features listed hereinabove or hereinbelow.

BRIEF DESCRIPTION OF THE FIGURES

Other specific features and advantages will become apparent from reading the description which follows, which is given with reference to the figures in which.

DETAILED DESCRIPTION OF THE INVENTION

Figure 1:
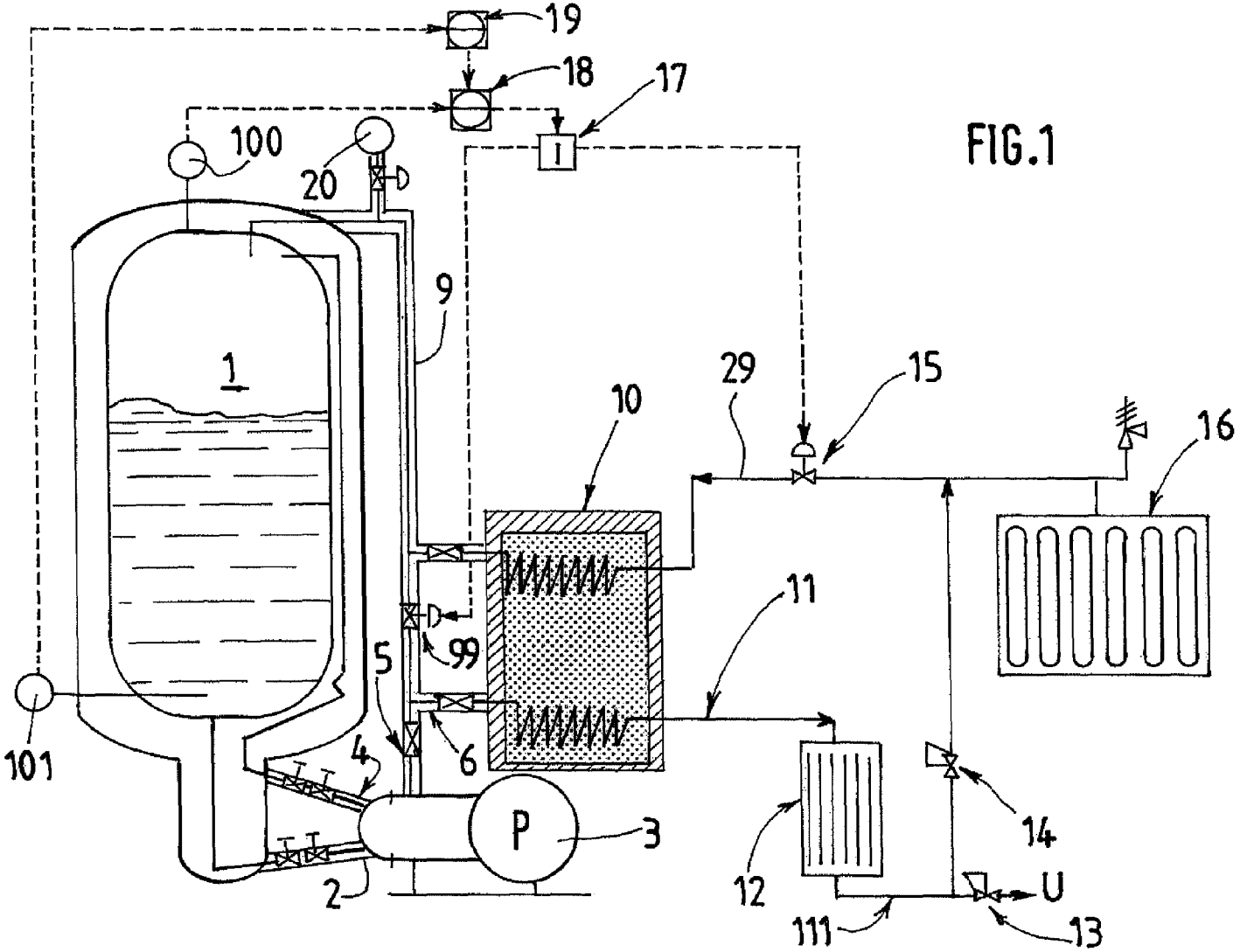
FIG. 1 is a schematic view illustrating the structure and operation of a device for pumping a cryogenic fluid according to a first embodiment of the invention.

Referring now to FIG. 1, the device comprises a tank 1 of cryogenic fluid (insulated under vacuum) containing a liquid-gas mixture, for example at temperature and a pressure of between 1 and 12 bar abs. The temperature and the pressure in the tank 1 are measured by corresponding sensors 101, 100.

The lower part of the tank 1 is connected to the suction inlet of a cryogenic pump 3 by a suction line 2 which is insulated under vacuum and comprises one or more isolation valves.

The pump 3 comprises a gas discharge line 4 (for the gas produced for example by heating/friction) discharging it to the upper part of the tank 1 and fitted with valves.

The pump is connected to a high-pressure delivery line 5 generally incorporating a delivery valve (high-pressure outlet of the pumped fluid). The high-pressure delivery line 5 is connected to a cold-hydrogen supply line 6 supplying cold hydrogen to an exchanger 10, preferably one with high inertia. On leaving the exchanger 10, the fluid passes through a cold high-pressure line 11 and then through a high-pressure atmospheric reheater 12 (or the equivalent) until it reaches a gas supply line 111 that has an end that can be connected to a user U (tank or cylinder for example), via a pressure regulator 13.

The thermally insulated high-pressure delivery line 5 is also connected to the upper part of the tank 1 via a pipe 9 for pressurizing the tank 1 with cooled hydrogen from the pump 3. The tank 1 pressurizing pipe 9 comprises an expansion valve 99 and/or a control valve. The upper end of the tank 1 is connected to a tank depressurizing valve 20 (venting to the outside), for example via the pressurizing pipe 9.

The pressurizing pipe 9 is also connected to a pressurized-gas source 16 such as cylinders 16 at ambient temperature via a line 29 that passes through the high-inertia exchanger 10 (exchanging heat therewith) and comprising a control valve 15 (for example an expansion valve).

The gas supply line 111 is also connected to the high-pressure source 6 via an expansion valve 14.

A unit 18 for controlling the pressure in the tank 1 receives pressure information from the pressure sensor 100 and drives a selector 17 which selectively activates the expansion valve/control valve 99 of the pressurizing pipe 9 and the control valve 15 of the line 29 connected to the pressurized-gas source 16. A computation unit 19 determines the saturation pressure in the tank 1 as a function of the temperature recorded by the pressure-relief valve 101 and instructs the control unit 19 according to the result.

In one possible example of operation with a supercooled liquid hydrogen tank 1, the hydrogen at the pressure and temperature of the tank 1 is supplied by the tank 1 to the pump 3 via the insulated vacuum line 2. The hydrogen is pumped by the pump 3 and is discharged at high pressure (for example between 200 and 850 bar) by the delivery line 5 to the exchanger 10 then the cold high-pressure line 11.

The reheater 12 increases the temperature of the hydrogen up to ambient temperature.

The expansion valve 14 ensures that the tanks 16 are at a maximum pressure. The upstream regulator 13 controls the pressure in the pump.

According to the invention, the system controls the pressure in the tank 1 The reference pressure of the tank 1 is calculated by the computation unit 19 so that the pressure in the tank is equal to the saturation temperature of hydrogen at the raised temperature (101) plus the inlet head loss (NPSH) of the pump 3 and the head losses in the suction pipework 2. The value of the head loss (NPSH) is quoted, for example, by the supplier of the pump 3.

The device according to the invention has the possibility, while the pump 3 is operating, of using hydrogen directly from the cold high-pressure outlet 5 of the pump 3 (for example hydrogen at around 70° K for pressure of 450 bar). This hydrogen supplied by the pump 3 can be expanded via the valve 99 in the pressurizing pipe 9 and reinjected into the tank 1 in the form of cold gas and/or liquid.

The device according to the invention additionally has the possibility, before the pump 3 starts up, of using high-pressure cylinders 16 at ambient temperature to inject cold hydrogen (cold because it is passed through the exchanger/accumulator 10) into the tank 1 in order to supercool the hydrogen, pressurizing the tank 1.

The cold accumulator (in the exchanger 10) is, for example, made cold beforehand during the previous operating of the pump 3. The cold accumulator can be insulated using polyurethane foam or the like.

This makes it possible to avoid any cavitation on the suction side of the pump 3.

When the pump 3 is shut down, the tank 1 can be depressurized using the tank 1 depressurizing valve 20, so that the hydrogen remaining in the tank 1 can be cooled.

According to one advantageous particular feature of the invention, the hydrogen used to pressurize the tank 1 is thus precooled. The thermal stratification of the gas in the tank is then lower, its increase in pressure is slower, and this increases the amount of pumping time available before the tank 1 reaches its maximum operating pressure.

In addition, the high-inertia exchanger 10, which is preferably insulated from the outside, provides a source of cold and allows the tank 1 to be pressurized using cold hydrogen even when the pump 3 is not in operation (using cylinders 16 or the equivalent). The thermal inertia of the exchanger 10 and the way in which it is insulated is determined so that its temperature preferably remains constant (+/−10° C.) between two phases of operation of the pump 3.

The device described allows the pressure in the tank 1 to be controlled more precisely and more quickly than in the prior art, notably by comparison with a thermosiphon system.

Figure illustrates an alternative form which differs from the embodiment of FIG. 1 only as regards the gas discharge line 4. The other elements are denoted by the same references and will not be described again.

Figure 2:
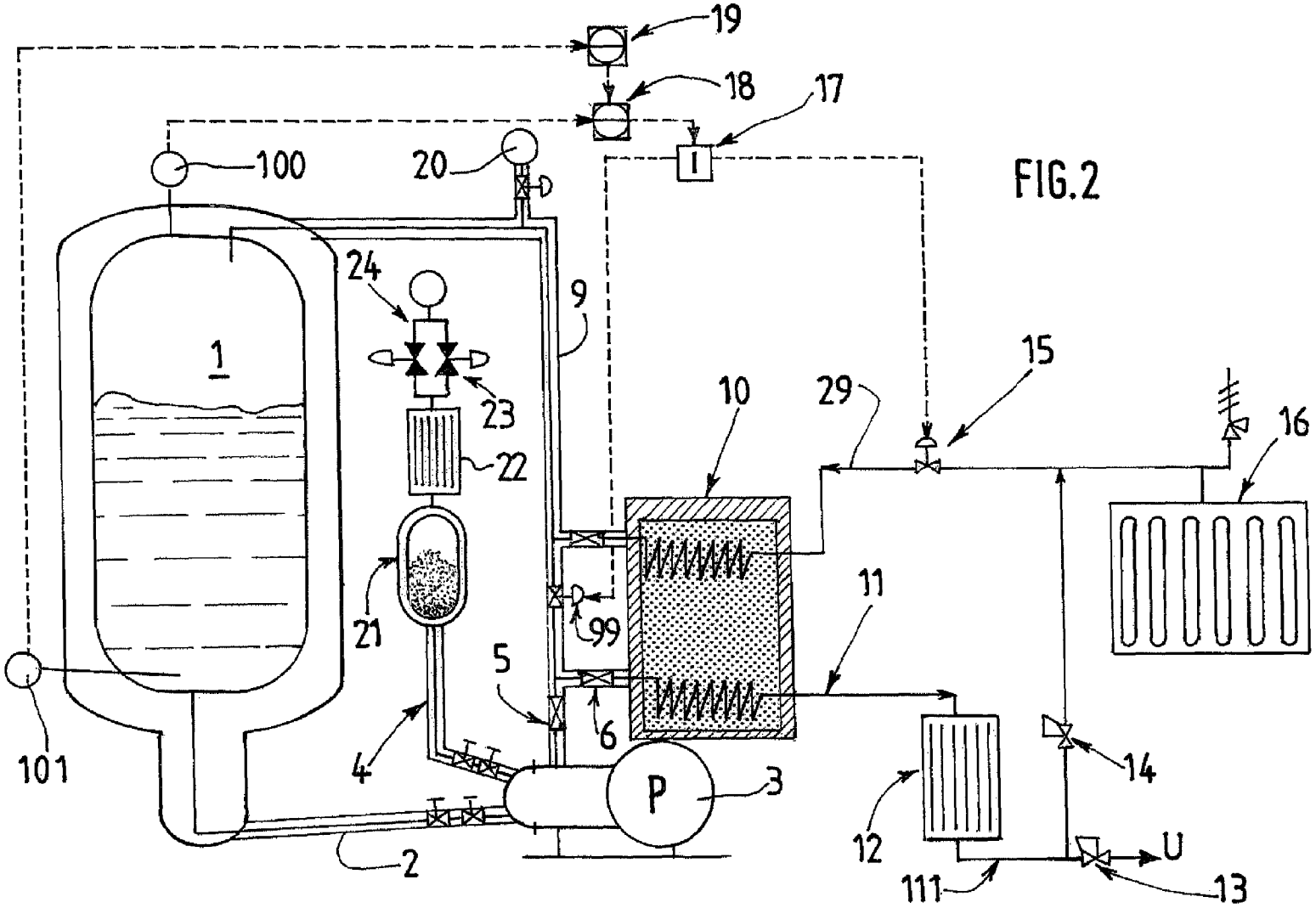
FIG. 2 is a schematic view illustrating the structure and operation of a device for pumping a cryogenic fluid according to a second embodiment of the invention.

In the embodiment of FIG. 2, the hydrogen discharge or return line 4 is returned to a volume 21 known as the degassing volume. In this configuration, the return line 4 communicates with a degassing tank 21 the level in which is controlled by valves 23, 24, having been heated up by an atmospheric reheater 22. This configuration makes it possible to prevent hot hydrogen from returning to the cryogenic tank 1 and from heating up all the liquid hydrogen contained therein.

The invention makes it possible thus to achieve supercooling of the cryogenic fluid and suction of the fluid thus supercooled. The inlet head loss is thus compensated for, avoiding any phenomenon of cavitation in the pump 3 while the fluid is kept at a pressure that is low enough to bring the density of the fluid and therefore the quantity pumped to a maximum.

In addition, the way in which the pressurizing of the tank 1 is controlled according to the invention has little or no effect on the level of liquid in the tank and therefore on the pumping time available before the tank 1 reaches its maximum operating pressure.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A device for pumping a cryogenic fluid, comprising:

a storage tank for storing a cryogenic fluid containing cryogenic liquid;

a cryogenic pump for pumping the cryogenic liquid from the storage tank, the cryogenic pump having an inlet head loss;

a suction line connecting the tank to the pump allowing the cryogenic liquid to be pumped from the storage tank;

a temperature sensor adapted to measure a temperature of the cryogenic liquid in the storage tank;

a computation unit adapted to receive the measured temperature of the cryogenic liquid in the storage tank from the temperature sensor and calculate a saturation pressure of the cryogenic liquid in the storage tank;

a pressure sensor adapted to measure a pressure in the storage tank; and a pressure control system comprising a first pipe connecting a liquid outlet of the pump to the tank, the first pipe comprising an expansion valve adapted to expand the cryogenic liquid in the first pipe, the pressure control system being adapted to receive the calculated saturation pressure from the computation unit and the measured pressure from the pressure sensor and selectively keep the pressure in the tank at least equal to the sum of the saturation pressure of the cryogenic fluid stored and the inlet head loss of the cryogenic pump by selectively activating the expansion valve to allow any cryogenic liquid and vaporized cryogenic liquid from said activation to be injected into the tank based upon the measured pressure, the inlet head loss, and the calculated saturation pressure.

2. The device of claim 1, wherein the pressure control system comprises a second pipe connecting a pressurized gas source to the tank via a cooling member, so as to inject cooled gas into the tank when the pump is inactive.

3. The device of claim 2, wherein the cooling member comprises a heat exchanger adapted to selectively place the gas from the pressurized gas source in a heat-exchange relationship with the cryogenic fluid pumped from the tank.

4. The device of claim 3, wherein the heat exchanger comprises a cold energy accumulator so as, through thermal inertia, to maintain a cooling power of the heat exchanger in between two uses of the pump.

5. The device of claim 1, wherein the pressurized gas source is connected to the liquid outlet of the pump via at least one of: a valve, an expansion valve, and a heater, so as to allow said source to be selectively filled with fluid from the tank.

6. The device of claim 1, further comprising a discharge line for discharging the gas generated by the operation of the pump, said gas discharge line connecting a gas outlet of the pump to the tank or to a separate degassing storage facility.

7. The device of claim 1, wherein the suction line has a head loss value and the pressure control system is adapted to selectively keep the pressure in the tank at least equal to the sum of the saturation pressure of the cryogenic fluid stored, the cryogenic pump inlet head loss, and the value of the suction line head loss.

8. The device of claim 7, wherein the pressure control system comprises a second pipe connecting a pressurized gas source to the tank via a cooling member, so as to inject cooled gas into the tank when the pump is inactive.

9. The device of claim 7, wherein the cooling member comprises a heat exchanger adapted to selectively place the gas from the pressurized gas source in a heat-exchange relationship with the cryogenic fluid pumped from the tank.

10. The device of claim 9, wherein the heat exchanger comprises a cold energy accumulator so as, through thermal inertia, to maintain a cooling power between uses of the pump.

11. The device of claim 7, further comprising a discharge line for discharging the gas generated by the operation of the pump, said gas discharge line connecting a gas outlet of the pump to the tank or to a separate degassing storage facility.

12. A method for pumping a cryogenic fluid from a cryogenic fluid tank containing cryogenic liquid, comprising the steps of:

pumping the cryogenic liquid from the storage tank, via a suction line, with a cryogenic pump having an inlet head loss;

measuring a temperature of the cryogenic liquid in the tank;

measuring a pressure in the tank;

calculating a saturation pressure of the cryogenic liquid in the tank based upon the measured temperature; and controlling a pressure in the tank in order to selectively keep the pressure in the tank or in the suction line at least equal to the sum of the saturation pressure of the cryogenic fluid and the inlet head loss of the cryogenic pump, wherein said step of controlling the pressure in the tank involves introducing a cold gas into the tank at a temperature lower than an ambient temperature outside the tank, the cold gas introduced into the tank being supplied selectively by a first pipe connecting a liquid outlet of the pump to the tank when the pump is operating and by a second pipe connecting a pressurized gas source to the tank via a gas cooling member when the pump is shut down, said selective supply being achieved by controlling actuation of an expansion valve in the first pipe by a pressure control system based upon the measured pressure and the calculated saturation pressure, actuating of the expansion valve acting to expand the cryogenic liquid in the first pipe to form the cold gas.

13. The pumping method of claim 12, wherein the cold gas supplied by the first pipe is obtained by expanding the fluid from the liquid outlet of the pump, and in that a cooling member cools the gas from the pressurized gas source uses the cold energy of the fluid pumped from the tank.

14. The method of claim 13, wherein the cold gas is introduced into the tank at a temperature of between 40° K and 100° K.

15. The method of claim 13, wherein the cold gas is introduced into the tank at a pressure of between 1 and 12 bar.

16. The method of claim 12, wherein:

the suction line has a head loss value; and the pressure in the tank is controlled in order to selectively keep the pressure in the tank or in the suction line at least equal to the sum of the saturation pressure of the cryogenic fluid, the cryogenic pump inlet head loss, and the value of the suction line head loss.

17. The pumping method of claim 16, wherein the cold gas supplied by the first pipe is obtained by expanding the fluid from the liquid outlet of the pump, and in that cooling member cools the gas from the pressurized gas source with the cold energy of the fluid pumped from the tank.

18. The method of claim 17, wherein the cold gas is introduced into the tank at a temperature of between 40° K and 100° K.

19. The method of claim 17, wherein the cold gas is introduced into the tank at a pressure of between 1 and 12 bar.

* * * * *